US008746561B1

(12) United States Patent
Gladwell et al.

(10) Patent No.: US 8,746,561 B1
(45) Date of Patent: Jun. 10, 2014

(54) GRID-BASED PRECISION AIM SYSTEM AND METHOD FOR DISRUPTING SUSPECT OBJECTS

(75) Inventors: Thomas Scott Gladwell, Albuquerque, NM (US); Justin Garretson, Albuquerque, NM (US); Clinton G. Hobart, Albuquerque, NM (US); Mark J. Monda, St. Louis, MO (US)

(73) Assignee: Sandia Corporation, Albuquerque, NM (US)

( * ) Notice: Subject to any disclaimer, the term of this patent is extended or adjusted under 35 U.S.C. 154(b) by 328 days.

(21) Appl. No.: 12/977,349

(22) Filed: Dec. 23, 2010

(51) Int. Cl.
*G06F 19/00* (2011.01)

(52) U.S. Cl.
USPC ..... 235/404; 235/400

(58) Field of Classification Search
USPC ..... 235/400–418
See application file for complete search history.

(56) References Cited

U.S. PATENT DOCUMENTS

| | | | | |
|---|---|---|---|---|
| 4,046,055 | A | 9/1977 | McDanolds et al. | |
| 4,062,112 | A | 12/1977 | Lake | |
| 4,169,403 | A | 10/1979 | Hanson | |
| 4,779,511 | A | 10/1988 | Proctor et al. | |
| 4,957,027 | A | 9/1990 | Cherry | |
| 5,210,368 | A | 5/1993 | Heller, Jr. et al. | |
| 5,515,767 | A | 5/1996 | Gilbert | |
| 6,281,507 | B1 | 8/2001 | Ghelmansarai | |
| 6,298,763 | B1 * | 10/2001 | Greenfield et al. | 89/1.13 |
| 6,359,961 | B1 | 3/2002 | Aufrichtig et al. | |
| 6,644,166 | B2 | 11/2003 | Alexander et al. | |
| 7,066,645 | B2 | 6/2006 | Reid et al. | |
| 7,110,502 | B2 | 9/2006 | Tsuji | |
| 7,228,778 | B2 | 6/2007 | Edwards et al. | |
| 7,336,765 | B1 * | 2/2008 | Amiton et al. | 378/98.12 |
| 2005/0025280 | A1 | 2/2005 | Schulte | |
| 2008/0112541 | A1 | 5/2008 | Hardesty | |
| 2008/0254738 | A1 | 10/2008 | Brumley et al. | |
| 2009/0189091 | A1 | 7/2009 | Holly et al. | |

* cited by examiner

*Primary Examiner* — Matthew Mikels
(74) *Attorney, Agent, or Firm* — The JL Salazar Law Firm PLLC; Olivia J. Tsai

(57) ABSTRACT

A system and method for disrupting at least one component of a suspect object is provided. The system has a source for passing radiation through the suspect object, a grid board positionable adjacent the suspect object (the grid board having a plurality of grid areas, the radiation from the source passing through the grid board), a screen for receiving the radiation passing through the suspect object and generating at least one image, a weapon for deploying a discharge, and a targeting unit for displaying the image of the suspect object and aiming the weapon according to a disruption point on the displayed image and deploying the discharge into the suspect object to disable the suspect object.

15 Claims, 10 Drawing Sheets

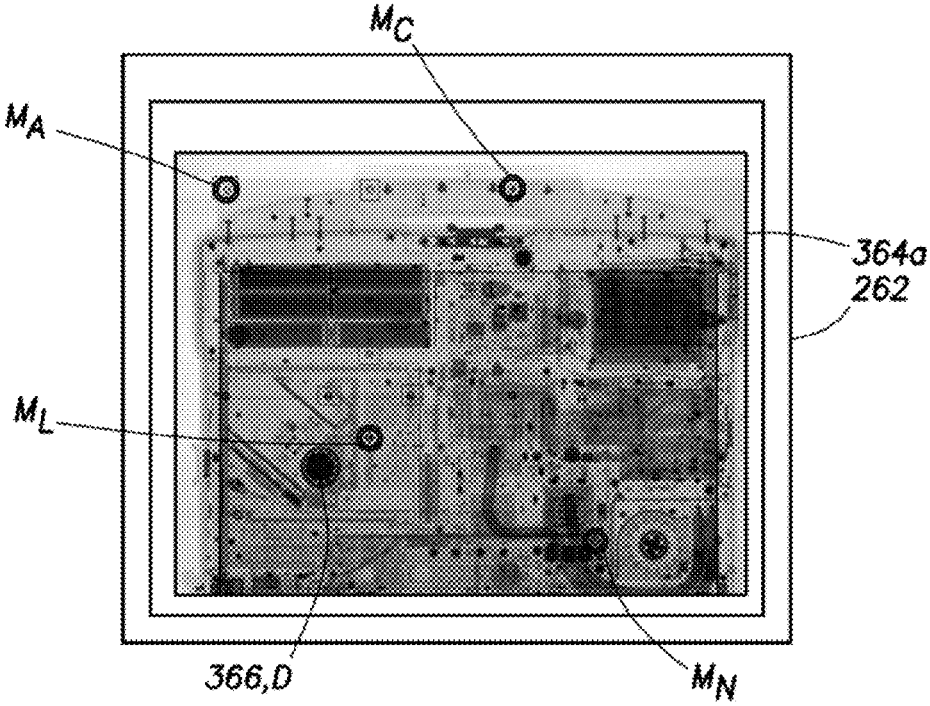
FIG.3A
FIG.3B
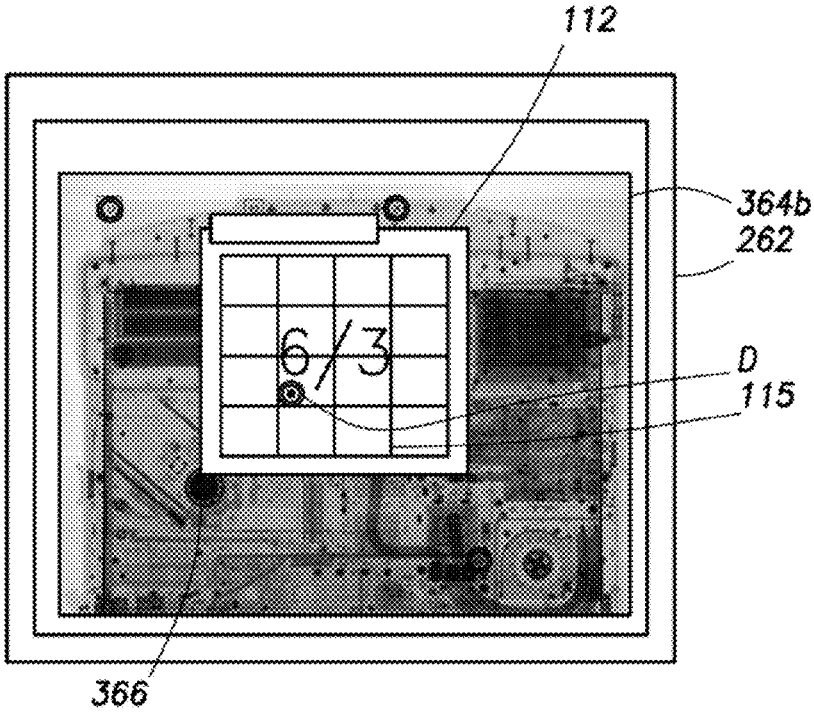

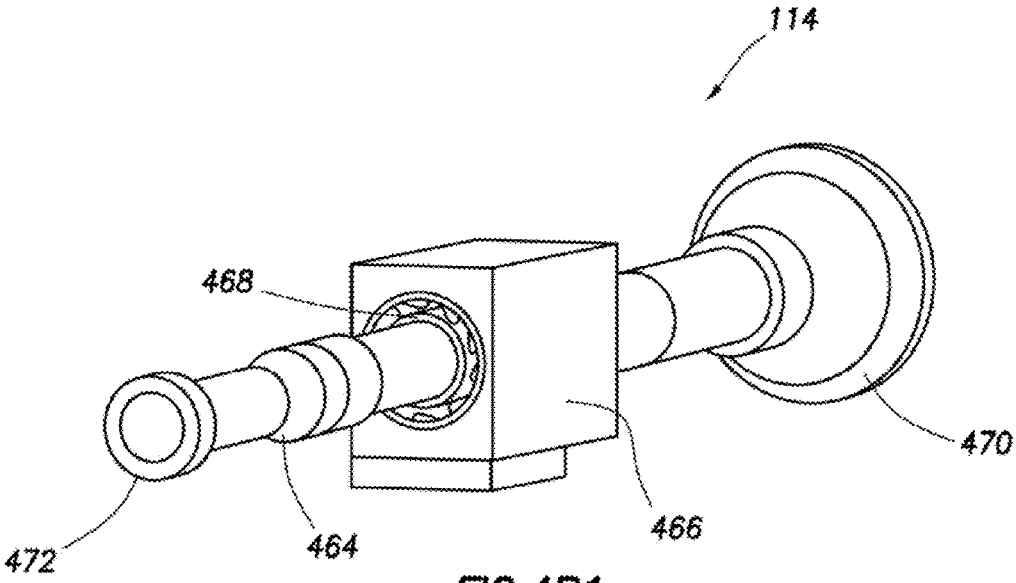
FIG.4B1
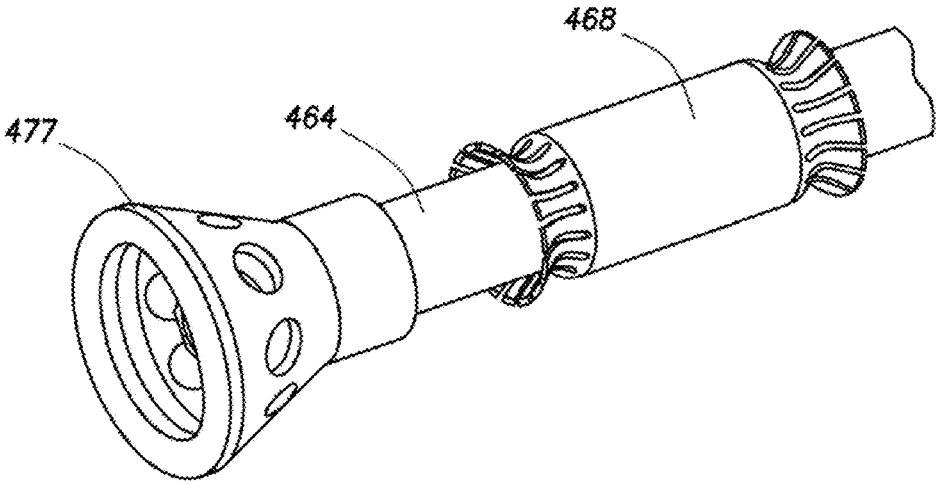
FIG.4B2

GRID-BASED PRECISION AIM SYSTEM AND METHOD FOR DISRUPTING SUSPECT OBJECTS

STATEMENT OF GOVERNMENT INTEREST

This invention was developed under Contract DE-AC04-94AL85000 between Sandia Corporation and the U.S. Department of Energy. The U.S. Government has certain rights in the invention.

CROSS REFERENCE TO RELATED APPLICATIONS

Applicant has also filed U.S. Non-Provisional Application No. 12/912,151 on Oct. 26, 2010, entitled SYSTEM AND METHOD FOR DISRUPTING SUSPECT OBJECTS, and U.S. Non-Provisional Application No. 12/568,774 on Sep. 29, 2009 entitled METHOD AND APPARATUS FOR DISRUPTING COMPONENTS OF EXPLOSIVE DEVICES.

BACKGROUND OF THE INVENTION

1. Field of the Invention

The present invention relates to techniques for disrupting a suspect object. More particularly, the present invention relates to techniques for investigating, targeting, disabling and/or otherwise disrupting a suspect object, such as an explosive device.

2. Background of the Related Art

Suspect objects are items that potentially pose a significant threat to persons and/or property. A suspect object may be, for example, a luggage, box or other container that is suspected of containing dangerous materials (e.g., explosives, volatile materials, toxins, etc.) that may cause injury and/or damage. Techniques have been developed to detect suspect objects as described, for example, in U.S. Patent Application No. 2005/0,025,280. It may be preferable to investigate the contents of the suspect object without touching the object. Techniques have been developed to position or image an object as described, for example in U.S. Pat. Nos. 6,359,961, 6,281,507, 7,066,645, 7,110,502, and Ser. No. 2008/0,112,541.

In cases where the suspect object is determined to pose a threat, it is often necessary to de-activate, neutralize or otherwise disable the suspect object or one or more of its components to render the suspect object inoperable. Attempts have been made to disable explosive devices by deploying projectiles or substances into explosive devices (as described, for example, in U.S. Pat. Nos. 4,046,055, 4,169,403, 4,779,511, 4,957,027, 5,210,368, 5,515,767, 6,298,763, 6,644,166, and 7,228,778), or by disabling electrical components within the explosive device (as described in U.S. patent application Nos. 4,062,112, 2009/0,189,091, or 2008/0,254,738).

Despite the development of techniques for identifying or disabling suspect objects, there remains a need for advanced techniques for effectively disrupting suspect objects. It may be desirable to investigate the suspect object, preferably without contacting the suspect object. Such investigation preferably provides a highly accurate view of the contents of the suspect object. It may be further desirable to disable the suspect object, preferably from a distance. Such disablement is preferably accurately aimed at key components of the suspect object. Preferably, such capabilities involve one or more of the following, among others: compact operability, portability, easy assembly and use, transportability, accuracy, operation in difficult conditions, simple operation, disruption of select components (preferably without affecting other components), preventing suspect object and/or component operation, visually inspecting the explosive device and/or its contents, manual and/or automatic operation, etc.

BRIEF DESCRIPTION OF THE DRAWINGS

So that the features and advantages of the present invention can be understood in detail, a more particular description of the invention may be had by reference to the embodiments thereof that are illustrated in the appended drawings. These drawings are used to illustrate only typical embodiments of this invention, and are not to be considered limiting of its scope, for the invention may admit to other equally effective embodiments. The figures are not necessarily to scale and certain features and certain views of the figures may be shown exaggerated in scale or in schematic in the interest of clarity and conciseness.

FIGS. 2B-2E depict portions 2B-2E of the image of FIG. 2A.

FIGS. 3A-3B are pictorial images of screen displays generated by the system of FIG. 1A, the screen displays depicting selection of a disruption point.

FIGS. 4A-4B2 are schematic diagrams depicting a weapon unit.

DETAILED DESCRIPTION OF THE INVENTION

Presently preferred embodiments of the invention are shown in the above-identified figures and described in detail below.

Figure 1A:
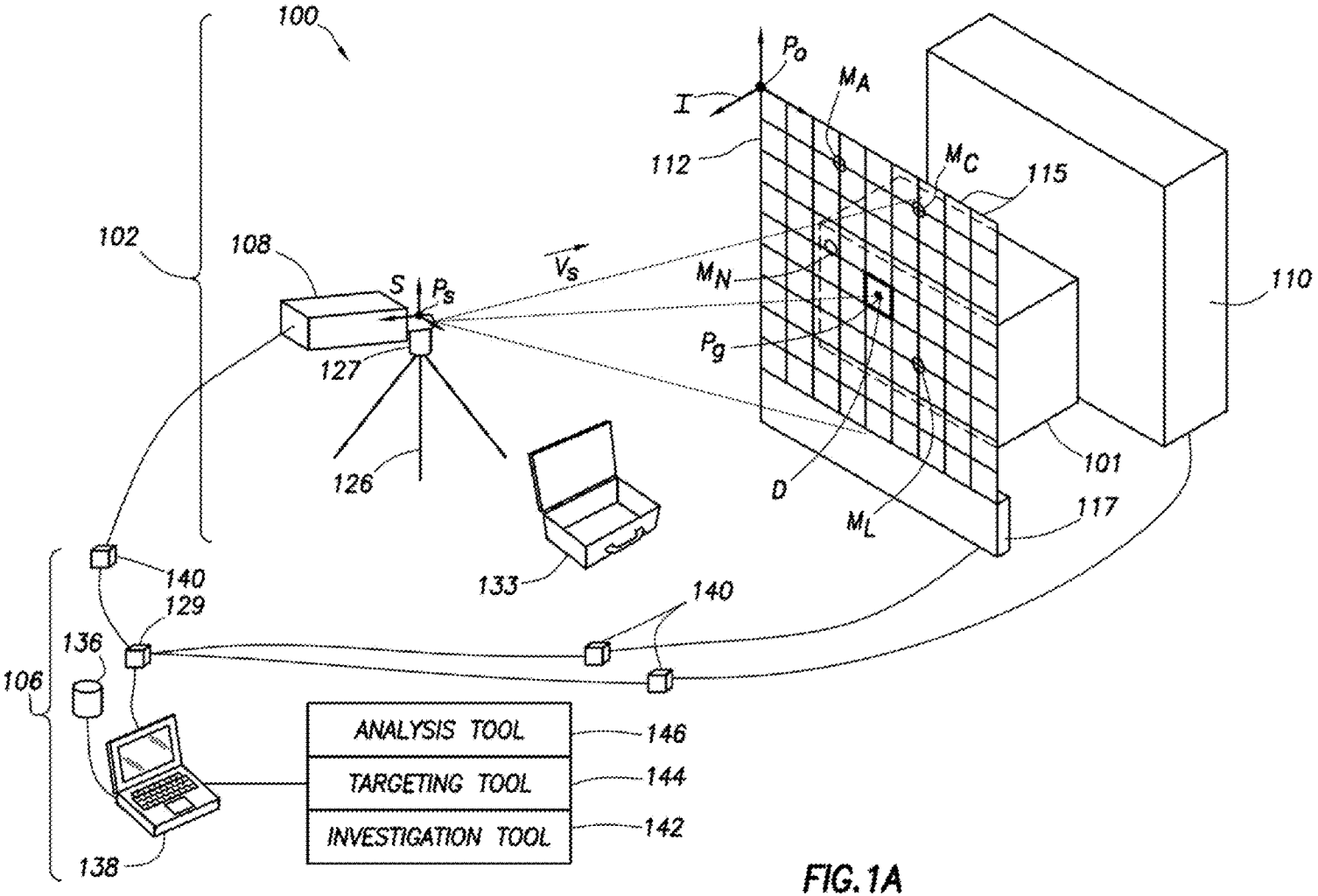
FIGS. 1A and 1B are schematic diagrams depicting a system for disrupting a suspect object, in accordance with the invention.
Figure 1B:
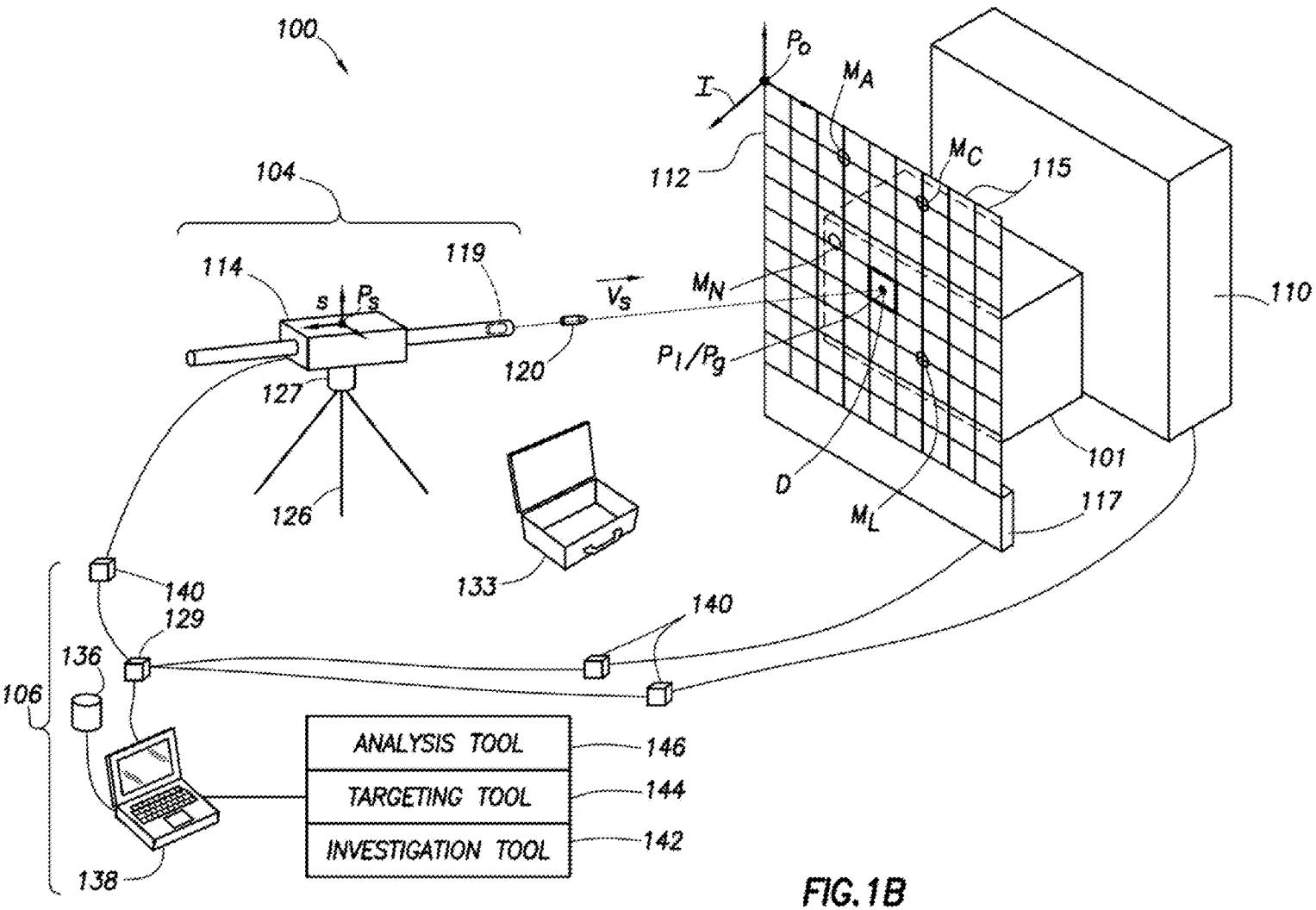

FIGS. 1A and 1B are schematic diagrams depicting a configuration of a disruption system 100 for disrupting a suspect object 101. The disruption system 100 has an investigation unit 102 to investigate the suspect object, a weapon unit 104 to disable the suspect object, and a targeting unit 106 for aiming the weapon unit 104 at the suspect object 101.

As shown in FIG. 1A, the investigation unit 102 includes a source 108, a screen 110 and a grid board 112. The source 108 is positioned for passing radiation through the suspect object 101, and creating images of the suspect object 101 onto the screen 110 (e.g., X-ray images). The source 108 may be a conventional radiation source capable of emitting sufficient radiation through the suspect object 101 to generate an image on screen 110. One or more sources 108 may be positioned about the object for passing radiation therethrough to create the desired images. The source(s) 108 may be mounted on a tripod 126 at a desired height as shown, or placed on the floor. An adjuster 127 may be provided to adjust the position of the source 108 on the tripod 126, thereby adjusting the direction of a cone of radiation emitted therefrom. Preferably, the source 108 is positioned to optimize the passage of radiation through the object 101 to enhance image generation therefrom. The screen 110 may be a conventional imager capable of receiving the radiation from the source 108 and generating an image therefrom. The screen 110 may be supported behind the suspect object 101.

The grid board 112 is positionable about the suspect object 101, preferably between the suspect object 101 and the source 108. The grid board 112 is preferably an x-ray transparent board positionable within an exposure path of the source 108. The grid board 112 may be of a material, such as plastic, composite or other material, which is sufficiently transparent to permit the passage of radiation therethrough. A support 117 may be provided to support the grid board 112 in position. The grid board 112 defines a plurality of individual grid areas 115 (shown as squares) that may be used for targeting. Each grid area 115 may be separately identified and located relative to the screen 110, as will be described further herein.

Markers (or fiducials) $M_A$, $M_C$, $M_L$ and $M_N$ are positioned about the grid board 112 to identify locations in the generated images. These markers may be, for example, tungsten members positioned at known locations about the grid board 112. As radiation passes through the grid board 112, the grid board 112 is preferably invisible, while the markers are visible on images generated on screen 110, as will be described further herein. The marker(s) may comprise identifying information (e.g., capital letters "A", "B", etc.) built into each marker, which show up as images of the letters "A", "B", etc. on screen 110.

The grid board 112 (and markers) of the investigation unit 102 preferably has known geometries about a grid board coordinate system 1 centered at position $P_0$ at a fixed point on grid board 112. The position $P_0$ of the grid board of each of the grid areas 115 on the grid board 112 and position $P_s$ at a fixed point on source 108 may be determined from the positions of the markers, as will be described further herein. A vector $V_s$ is defined from the position $P_s$ of source 108, through the object 101 and to a grid point $P_g$ at a given grid area 115. One or more sources 108 may be provided as needed to generate one or more vectors $V_s$ to define the geometry at a given grid area 115. The markers may be located in images on screen to define the geometry of the investigation unit 102. The geometry of the configuration may be used to determine positions of the components of the system 100 and the suspect object 101.

As shown in FIG. 1B, the weapon unit 104 has a weapon 114, a laser 119 and a discharge 120. Optionally, once imaging is complete, the source 108 may be removed from tripod 126, and the weapon 114 may be installed on the tripod 126 in place of the source 108. The weapon 114 is supported on the tripod 126 and adjuster 127, and is positionable thereon for releasing the discharge 120 to disable the suspect object, typically after the desired images have been taken using the source 108. This alternate configuration allows the use of a single tripod in a single location for supporting the source 108 and the weapon 114.

Since the weapon 114 is positioned in the same location as the source 108, a position of the weapon 114 may be the same position $P_s$ of the source 108. Once the disruption point D and the grid area 115 corresponding to the disruption point D is identified, the weapon 114 may be positioned on the tripod 126 and aligned to the grid area 115 using the laser 119. The laser 119 may be positioned in the weapon 114 and removed for firing. A discharge 120 (e.g., a bullet) may be inserted into the weapon 114, and the weapon 114 may then be fired at the selected grid area 115, and the discharge 120 deployed therefrom. The weapon 114 may be aligned with the grid board 112 to aim the weapon 114 such that the discharge 120 may be deployed to a disruption point D in a selected grid 115 on the suspect object 101, as will be described further herein.

Referring still to FIGS. 1A and 1B, the targeting unit 106 is schematically depicted as being linked to the investigation unit 102 and the weapon unit 104. A communication hub 129 may be provided for communication between the investigation unit 102, the weapon unit 104 and/or the targeting unit 106. The targeting unit 106 includes a database 136, a processor 138 and controllers 140. The targeting unit 106 may provide image acquisition, image enhancement, video tracking, real-time laser pose estimation, system component locators, image measurement, display updates, aiming instructions and other capabilities. A carrying case 133 may optionally be provided for transporting one or more components.

Data received from the investigation unit 102, weapon unit 104, and/or other sources (e.g., historical data, user inputs, etc.) may be stored in database 136. The processor 138 may use the data to generate images, perform calculations, generate reports, provide commands, etc. Other devices, such as power supplies, may also be provided to enhance operation of the targeting unit 106.

The processor 138 includes an investigation tool 142, a targeting tool 144 and an analysis tool 146. The investigation tool 142 may provide images of the suspect object 101 and its contents, and the targeting tool 144 may aim the weapon unit 104 at a selected disruption point D of the suspect object 101. The analysis tool 146 may be used alone or with the investigation tool 142 and/or the targeting tool 144 to assist in performing various operations, such as performing calculations, generating reports, generating commands and/or providing feedback, as will be described more fully herein. Commands generated by the processor 138 may be used to activate controller(s) 140 to operate the disruption system, as will be described further herein.

The investigation tool 142 may be used to compute the coordinates of the source 108, grid board 112, weapon 114, and/or the suspect object 101. These coordinates may then be related to the coordinates of the grid board 112 and/or individual grid areas 115 thereof. The investigation tool 142 may be used in conjunction with the analysis tool 146 to define one or more disruption points D of the suspect object 101.

As shown in FIG. 1B, the targeting unit 106 may also be linked to the weapon unit 104 for aiming the weapon 114 at the disruption point D of the suspect object 101. The targeting tool 144 may compute geometries of the weapon unit 104 to define a configuration for aiming the weapon 114 at the disruption point D. The targeting tool 144 receives information from the disruption system 100 to determine positioning of the components of the investigation unit 102, the contents of the suspect object 101 and the disruption point D. The targeting tool 144 may then be used to align the laser 119 and weapon 114 to the disruption point(s) D defined by the investigation tool 142. Preferably, real-time targeting instructions for aiming the weapon 114 at the desired disruption point(s) D are provided by the targeting tool 144.

Controller(s) 140 of the targeting unit 106 may be linked to the investigation unit 102 and the targeting unit 106 for selective activation thereof. The controller 140 may provide, for example, real-time adjustment of the source 108, screen 110, grid board 112, weapon 114, laser 119, and/or other components as desired. Optionally, some or all commands from the targeting unit 106 (or other sources) may be automatically generated for automatic adjustment, and/or manual adjustments may be made by operators receiving instructions from the controller 140. The controller 140 may be activated based on the outputs generated by the investigation tool 142, targeting tool 144 and/or analysis tool 146. For example, the weapon mount 127 (FIG. 1B) may be linked to controller 140 to position the weapon 114 in alignment with the disruption point D.

The targeting unit 106 may take the form of an entirely hardware embodiment, an entirely software embodiment (including firmware, resident software, micro-code, etc.) or an embodiment combining software and hardware aspects. Embodiments may take the form of a computer program embodied in any medium having computer usable program code embodied in the medium. The embodiments may be provided as a computer program product, or software, that may include a machine-readable medium having stored thereon instructions, which may be used to program a computer system (or other electronic device(s)) to perform a process.

A machine-readable medium includes any mechanism for storing or transmitting information in a form (such as, software, processing application) readable by a machine (such as a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. Embodiments may further be embodied in an electrical, optical, acoustical or other form of propagated signal (e.g., carrier waves, infrared signals, digital signals, etc.), or wireline, wireless, or other communications medium. Further, it should be appreciated that the embodiments may take the form of hand calculations, and/or operator comparisons. To this end, the operator and/or engineer(s) may receive, manipulate, catalog and store the data from the systems, tools and/or units in order to perform tasks depicted in the disruption systems described herein.

The targeting unit 106 of FIGS. 1A and 1B may be used to receive information, perform necessary calculations, analyze information and/or otherwise process the information to achieve the desired operation. The targeting unit 106 is linked to the investigation tool 142 for generating images of the suspect object 101, such as those shown in FIGS. 2A-E and 3A-B. The investigation tool 142 preferably uses state-of-the-art computer vision and position-registration technologies to generate and/or refine images from the data received from the investigation unit 102 (and/or other sources). Preferably, the investigation tool 142 provides 2D images of the suspect object 101 and 2D points therein as shown in FIGS. 2A-E.

FIGS. 2A-2E depict images 260*a-e* generated from the investigation unit 102 and displayed on display 262 of processor 138 (FIG. 1A). The investigation tool 142 (FIGS. 1A and 1B) may be used to gather the images and display them as shown. Preferably, images generated from radiation passing from the source 108, through grid board 112 and suspect object 101 and onto screen 110 (FIG. 1A) are shown. The images may be, for example, radiographs captured from an x-ray imaging unit, such as the investigation unit 102 of FIG. 1.

Figure 2A:
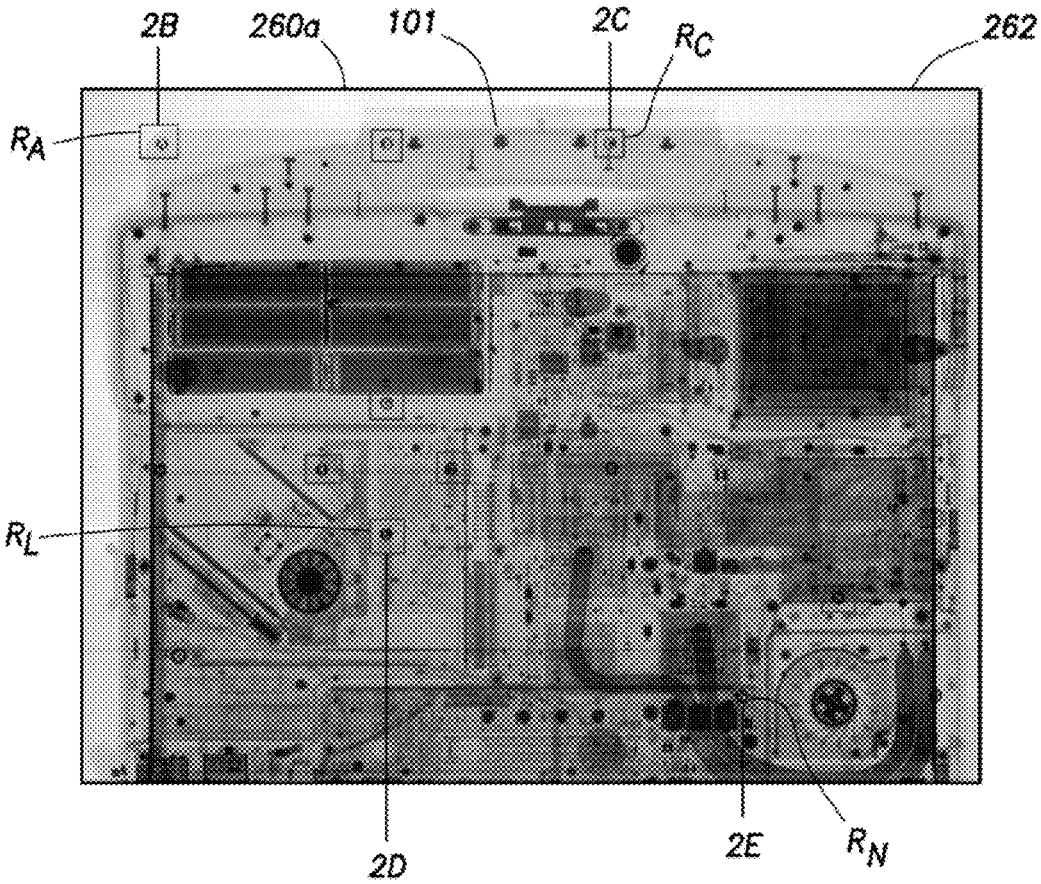
FIGS. 2A-2E are pictorial images of screen displays generated by the system of FIG. 1A, the screen displays depicting identification of markers.
Figure 2B:
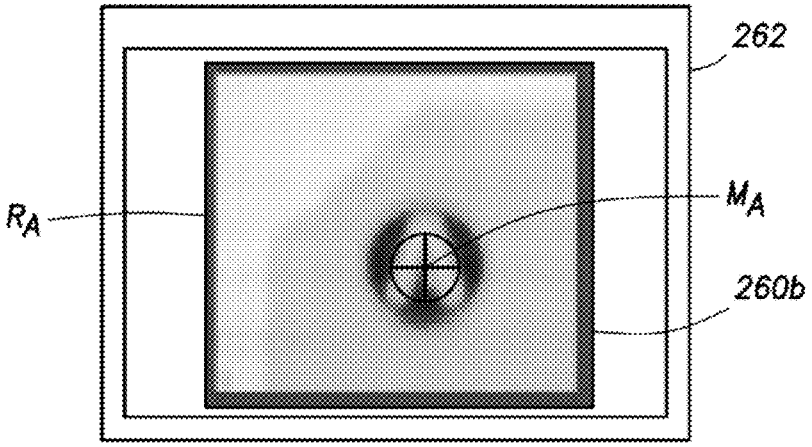
Figure 2C:
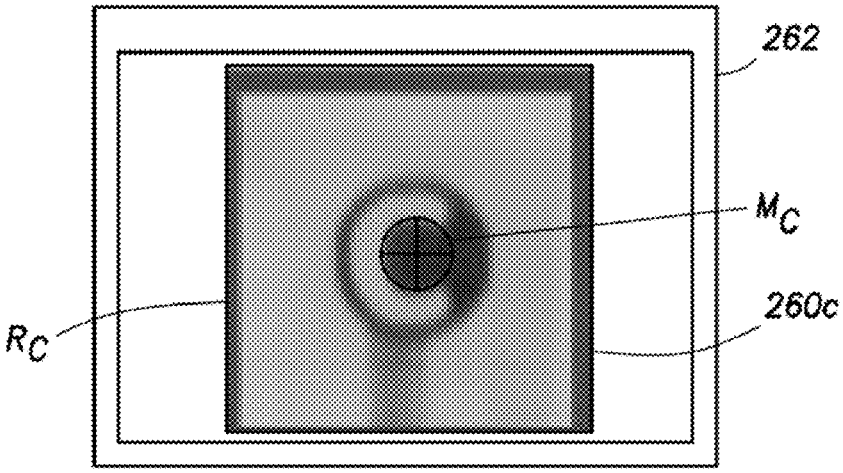
Figure 2D:
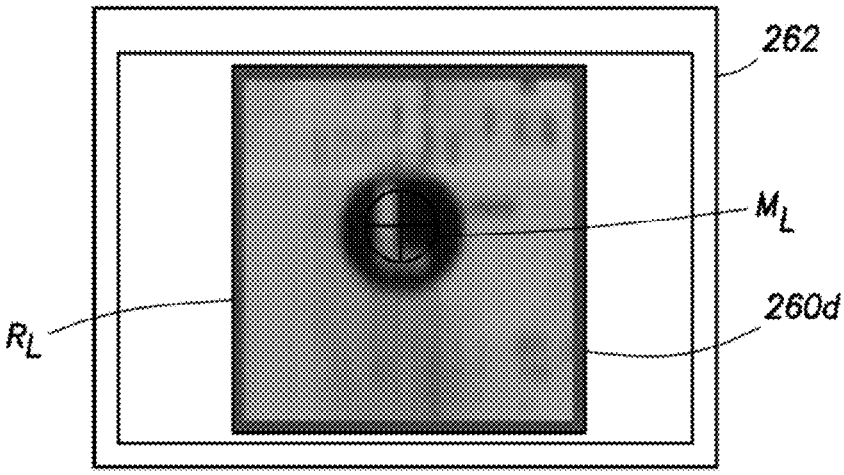
Figure 2E:
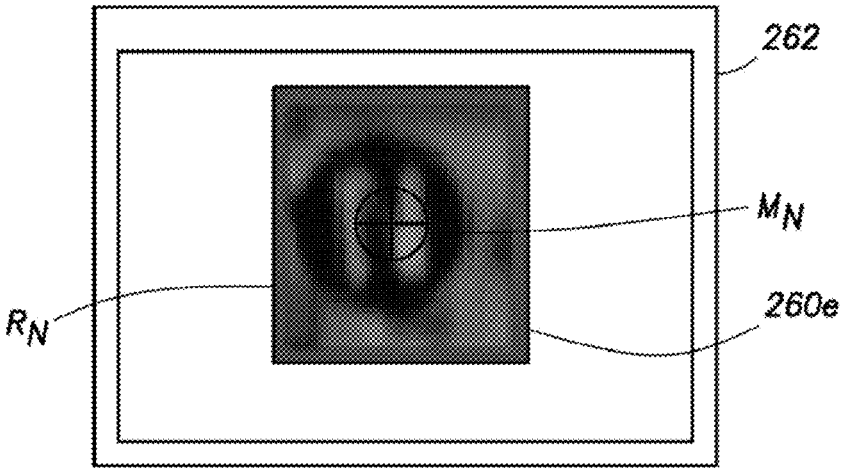

The markers MA, MC, ML and MN on grid board 112 are detected by the investigation unit 102 and identified on the images 260*a-e* as shown in FIG. 2A-2E. The location of each of the markers, as well as other geometry of the investigation unit 102 as described with respect to FIG. 1A, may be used to determine the position $P_s$ of the sources 108. As shown in FIG. 2A, a user may select screen regions corresponding to a given marker for identification. As shown in these figures, screen regions $R_A$, $R_C$, $R_L$ and $R_N$ have been selected.

Each of these screen regions may be enlarged (zoomed-in) and shown in full screen images as shown in FIGS. 2B-E. The user may move a cursor to a location of the marker on the full screen image and click the screen location for a given screen point. The selected screen point for each marker may be correlated to known geometries on the grid board 112 to identify locations. For example, by identifying screen locations for each marker $M_A$, $M_C$, $M_L$ and $M_N$, a correlation may be made between pixel locations on screen and the known physical location of each marker. One or more regions and corresponding markers may be selected. Once selected, the markers may be used to identify the location of components of the suspect object 101 and/or components of the system 100.

As shown in FIG. 3A, markers $M_A$, $M_C$, $M_L$ and $M_N$ have been selected and identified on screen image 364*a*. With the markers identified on the screen image 364*a*, the user may then select a component on the suspect object 101 to target. The user moves the cursor to a desired component displayed on display 262, and selects an ID point 366 on the image corresponding to the desired component in image 364*a*. The investigation unit 102 will use the known geometries of the markers to determine the location of the ID point 366 on the suspect object 101.

The location of the ID point 366 may be used to define the disruption point D on the suspect object 101, and correlate to a grid area 115 on the grid board 112 (FIG. 1) as pictorially depicted in FIG. 3B. The screen image 364*b* may display the grid board 112 and the selected grid area 115 correlating to the selected disruption point D of the ID point 366 on the image 364*b*.

Referring to FIGS. 1B, 3A and 3B, the weapon unit 104 is co-located with the coordinate system S of the source 108 and, therefore, has the same coordinate system therewith. The geometry of the weapon unit 104 may be determined from the known positions $P_s$ of the source 112 (which is also $P_s$ of the weapon 114). This information may be used to locate the weapon 114 in three dimensional space, and to aim the weapon 114 at the disruption point D on the suspect object.

The laser 119 may emit a laser point $P_1$ alignable with the disruption point D at position $P_g$. The laser point $P_1$ is preferably visible on the grid board 112 so that it may be moved to align with the disruption point D on screen 262 as shown in FIGS. 3A and 3B. The laser 119 may be manually aligned to a selected grid area 115 on the grid board 112 at position $P_g$. Once the laser 119 is aligned such that $P_1$ is on disruption point D, the weapon 114 is aligned such that vector V, is aligned to release discharge 120 to hit the disruption point D. Once aligned, the laser 119 may be removed and a discharge 120 inserted. The weapon 114 may then be activated to deploy the discharge 120. Preferably, weapon 114 is aligned sufficiently to deploy the discharge 120 into the suspect object 101 at the discharge point D to disable the operation thereof. The weapon 114 may be re-aligned to one or more disruption points D.

Figure 4A:
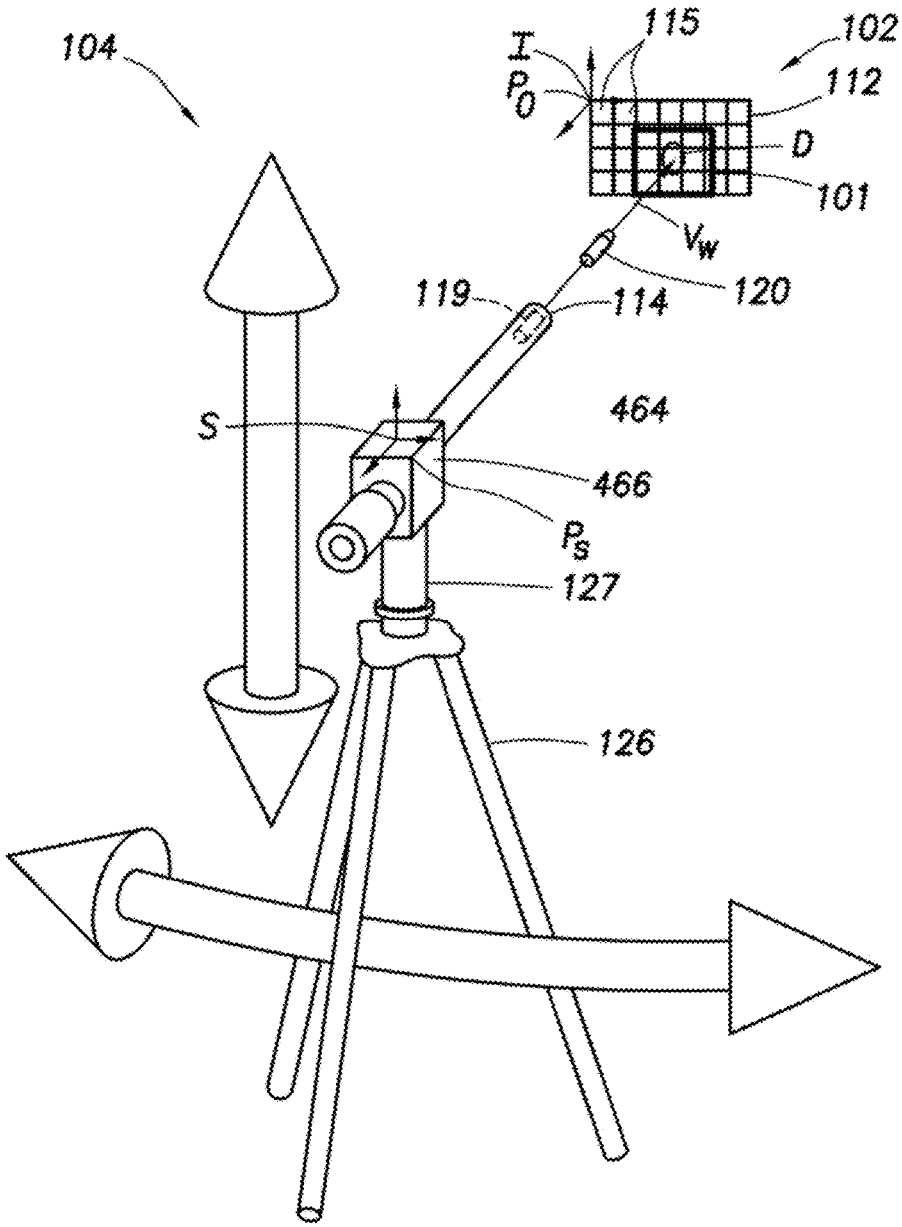

FIGS. 4A-5D provide various details that may be employed with the weapon unit 104. FIG. 4A is a schematic diagram depicting the weapon unit 104 of the disruption system 100 of FIG. 1A. The weapon unit 104 includes the weapon 114 adjustably mounted on tripod (or firing stand) 126. The tripod 126 has a weapon mount (or aiming stage) 127 that may be adjusted to provide vertical and radial adjustment of the weapon 114 positioned thereon. Preferably, the weapon mount 127 may be used to align the weapon to the disruption point D. Adjustment may be made manually by a user, or automatically by a controller 140 (FIG. 1).

FIGS. 4B1 and 4B2 show detailed views of portions of the weapon 114. The weapon 114 may be a conventional weapon, such as a PAN disrupter (FIG. 4A), T3 disrupter (FIGS. 4B1, 4B2), or other weapon capable of deploying a discharge into the suspect object 101 to disable operation thereof. The weapon 114 includes a firing shaft 464, a weapon block 466, and a disruptor sleeve 468. The weapon block 466 is positionable on the weapon mount 127. The weapon block 466 is positionable on the firing shaft 464 with the disruptor sleeve 468 therebetween. The sleeve 468 is configured to absorb recoil of the weapon 114 upon release of the discharge 120 to prevent potential damage to the components of the weapon unit 104. Preferably, the weapon block 466 and tripod 126 remain stationary during firing, with the firing shaft 464 moving within sleeve 468. A breech cap 470 may be positioned at a non-discharging end of the firing shaft 464. A muzzle protector 472 or 477 may be positioned on a discharge end of the firing shaft 464 as shown in FIGS. 4B1 and 4B2, respectively.

The firing shaft 464 may be hollow for deploying the discharge 120 therefrom. The discharge 120 may be a conventional projectile deployable by the weapon 114 into the suspect object 101. In such cases, the weapon 114 may be a gun, pressurized tube or other mechanism capable of deploying the discharge 120 into the suspect object. Alternatively, the discharge 120 may be, for example, an electrical signal emitted by the weapon into the suspect object 101 for disabling the electrical activation thereof.

As shown in FIG. 4A, laser 119 is removably positioned on the firing shaft 464 during alignment. The laser 119 may be used to provide a laser line visible on grid 112 for alignment with the disruption point D. The laser 119 may be a conventional laser capable of displaying a red dot on the grid board 112 to facilitate positioning. The laser 119 may be used to align with selected grid areas 115 of the grid board 112, and position the laser 119 relative to those features. The laser 119 preferably is used to assist in positioning of the weapon unit 104 relative to the grid board 112. Once aligned, the laser 119 may be removed, and the discharge 120 inserted for deployment.

Figure 5A:
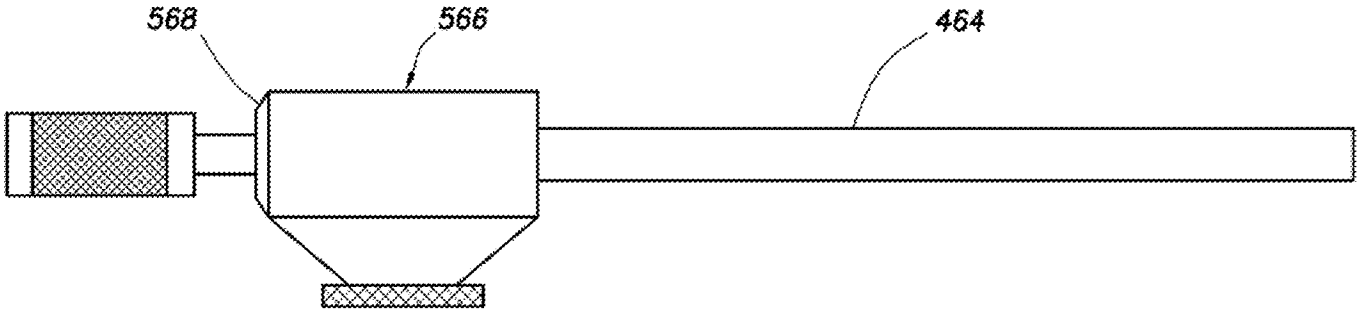
FIGS. 5A-5D are schematic diagrams depicting portions of an alternate weapon unit.
Figure 5B:
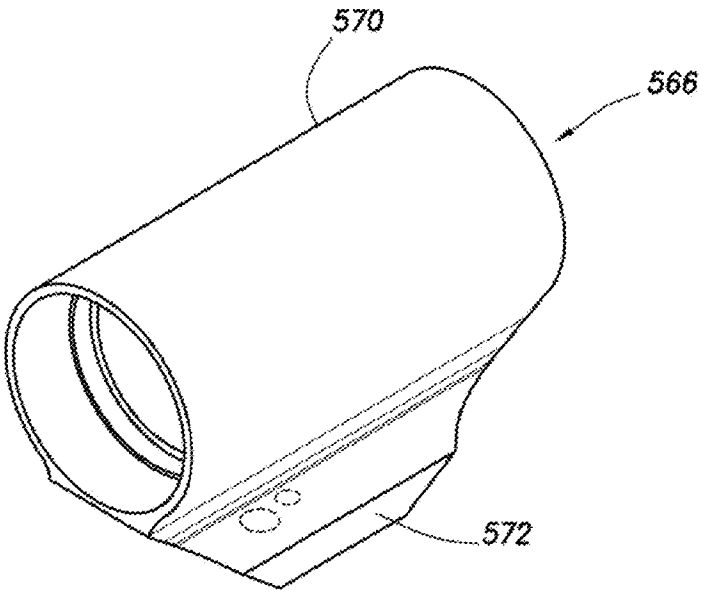
Figure 5C:
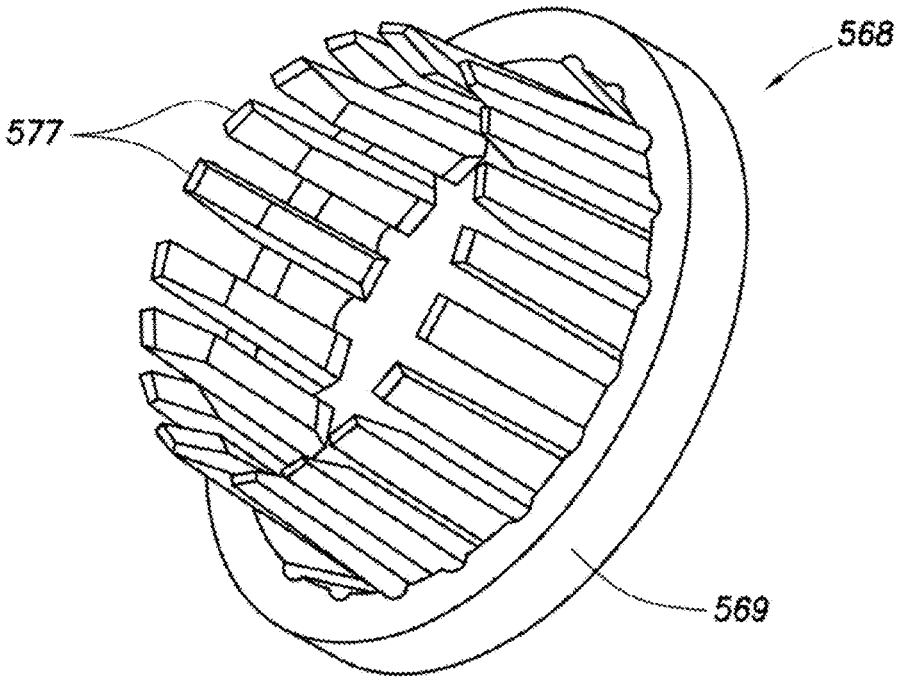
Figure 5D:
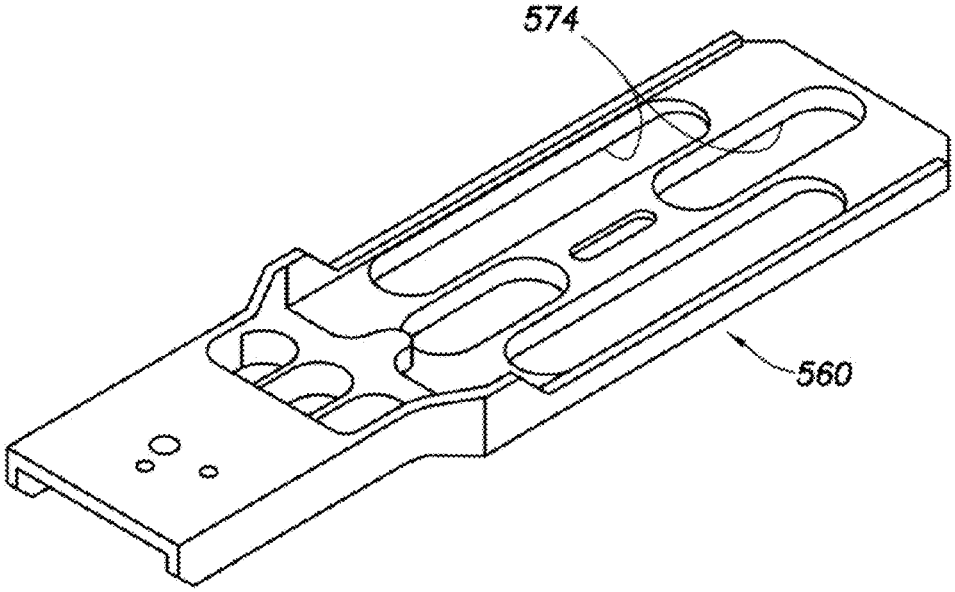

FIGS. 5A-5D depict alternate components usable with the weapon unit 104. The firing shaft 464 of FIG. 5A is provided with a weapon block 566, a disruptor sleeve 568, and a guide plate 560. The weapon block 566 is positionable on tripod 127 and/or mount 126 via guide plate 560. FIG. 5B shows a detailed view of the weapon block 566 having a tubular member 570 for receiving the firing shaft 464 and disruptor sleeve 568. Disruptor sleeve 568 is positioned about the firing shaft 464 and within the weapon block 566 to compliantly align the firing shaft 464 within the weapon block 566. A grip 572 extends from the tubular member 570. FIG. 5C shows a detailed view of the disruptor sleeve 568 having a ring 569 with a plurality of fingers 577. As shown in the detailed view of FIG. 5D, the guide plate 560 is an elongated member with slots 574 for securing the grip 572 of the weapon block 566 to the mount 127. Bolts or other fasteners (not shown) may be provided to secure the grip 572 to the mount 127. Slots 574 may be used to adjustably positioning of the weapon block 566 thereby facilitating positioning of the weapon 114.

Various features, such as alignment features, magnets or other devices, may be provided to secure the components of the weapon unit 104 in place to enhance precision and/or repeatability.

Figure 6:
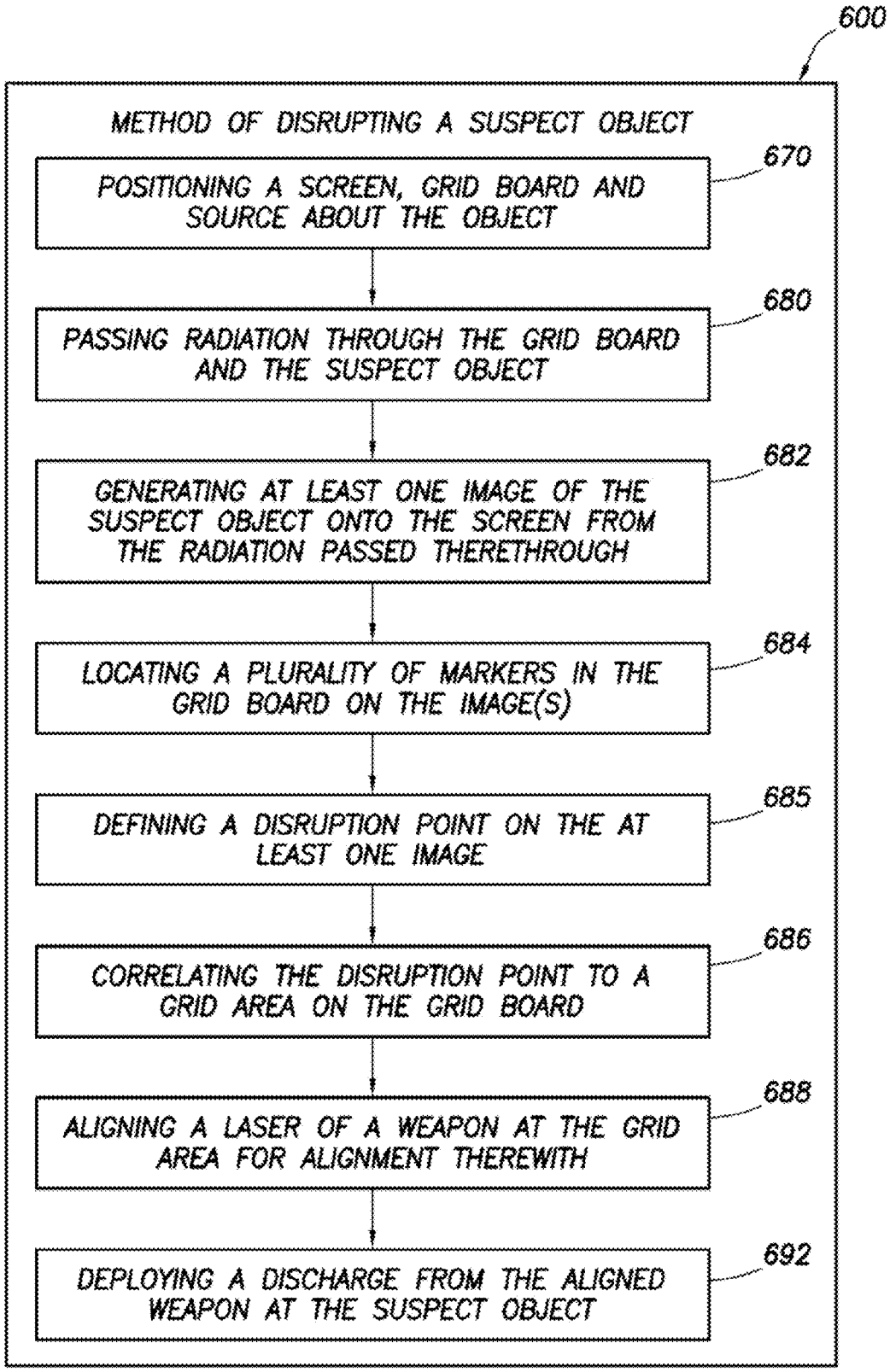
FIG. 6 is a flow chart depicting a method of disrupting a suspect object.

FIG. 6 is a flow chart depicting a method 600 of disrupting a suspect object 101. The method involves positioning 670 a screen, grid board and source about a suspect object, passing 680 radiation through the grid board and the suspect object, and generating 682 at least one image of the suspect object onto the screen from the radiation passed therethrough. The method further involves locating 684 a plurality of markers in the grid board on the image(s), defining 685 a disruption point on the at least one image, correlating 686 the disruption point to a grid area on the grid board, aligning 688 a laser of a weapon with the disruption point, and deploying 692 a discharge from the aligned weapon at the suspect object.

The method 600 may further involve processing data concerning the disruption system, processing data from the investigation and/or weapon units, analyzing data from the investigation and/or weapon units, performing calibrations, controlling the investigation and/or weapon units, and/or selectively adjusting a position of the investigation and/or weapon units. The steps may be performed in any order and repeated as desired.

It will be understood from the foregoing description that various modifications and changes may be made in the preferred and alternative embodiments of the present invention without departing from its true spirit. For example, the disruption system described herein may have one or more components of the investigation, weapon, and/or target units positionable about one or more suspect objects. One or more stands, extenders, mounts, relay units or other devices may be provided to position various components of the disruption system about the suspect object. Preferably, the devices are adjustable to permit selective positioning of the components. One or more disruption systems may be provided about one or more suspect objects. Preferably, the components of the disruption system are portable, adjustable and movable to provide various configurations as needed to conform to a given situation, and to effectively disrupt the suspect object.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A system for disrupting at least one component of a suspect object, comprising:

a source for passing a radiation through the suspect object;

a grid board positionable adjacent the suspect object, the grid board having a plurality of grid areas thereon, the radiation from the source passing therethrough;

a screen for receiving the radiation passing through the suspect object and generating at least one image therefrom; and a targeting unit for displaying the image of the suspect object and aiming a weapon having a discharge deployable therefrom according to a disruption point on the displayed image and deploying the discharge into the suspect object whereby the suspect object is disabled.

2. The system of claim 1, wherein the targeting unit comprises an investigation tool linked to the screen for selectively displaying the at least one image received therefrom.

3. The system of claim 1, wherein the targeting unit comprises a targeting tool linked to the weapon for selectively aiming the weapon.

4. The system of claim 1, wherein the targeting unit comprises an analysis tool for analyzing data.

5. The system of claim 1, wherein the targeting unit comprises at least one controller for selective activation thereof.

6. The system of claim 1, wherein the targeting unit comprises a database.

7. The system of claim 1, wherein the targeting unit comprises as display for displaying the at least one images.

8. The system of claim 1, wherein the grid board comprises a plurality of markers visible on the at least one image.

9. The system of claim 1, wherein the grid board is invisible on the at least one image.

10. The system of claim 1, further comprising a communication hub for linking the targeting unit to one of the screen, the weapon and combinations thereof.

11. The system of claim 1, further comprising a controller for selectively adjusting a position of the weapon.

12. The system of claim 1, further comprising a controller for selectively adjusting a position of the source.

13. The system of claim 1, wherein the weapon comprises a weapon shaft for deploying the discharge therethrough, a weapon block for supporting the weapon shaft and a weapon sleeve for supporting the weapon shaft in the weapon block.

14. The system of claim 1, wherein the weapon comprises a guide plate for adjustment thereof.

15. The system of claim 1, further comprising a laser positionable about the weapon for aiming the weapon at the grid board.

* * * * *